US006744456B2

(12) United States Patent
Fisher et al.

(10) Patent No.: US 6,744,456 B2
(45) Date of Patent: Jun. 1, 2004

(54) PREVENTING CREASE FORMATION IN DONOR WEB IN DYE TRANSFER PRINTER THAT CAN CAUSE LINE ARTIFACT ON PRINT

(75) Inventors: Terrence L. Fisher, Rochester, NY (US); Richard Salter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/242,262

(22) Filed: Sep. 12, 2002

(65) Prior Publication Data

US 2004/0051775 A1 Mar. 18, 2004

(51) Int. Cl.[7] ..... B41J 17/28; B41J 17/30; B41J 35/04

(52) U.S. Cl. ..... 347/216; 347/217; 400/248

(58) Field of Search ..... 400/236, 267, 400/248; 367/217, 216

(56) References Cited

U.S. PATENT DOCUMENTS 4,532,524 A * 7/1985 Yana et al. ..... 347/217

FOREIGN PATENT DOCUMENTS

JP 08-230262 * 9/1996 ..... B41J/17/30
JP 2000-334991 * 12/2000 ..... B41J/35/08

* cited by examiner

*Primary Examiner*—Huan Tran
(74) *Attorney, Agent, or Firm*—Roger A. Fields

(57) ABSTRACT

In a dye transfer printer, a donor web having successive dye transfer areas and opposite longitudinal edge areas alongside each one of the dye transfer areas is subjected to a longitudinal tension when the donor web is advanced in the printer. The longitudinal tension can stretch the dye transfer areas more than the edge areas because the dye transfer areas, but not the edge areas, are heated at a print head. According to the invention, the resistance of the edge areas relative to the dye transfer areas, to being stretched, is weakened so that the edge areas can be stretched substantially the same as the dye transfer areas. If the edge areas alongside a dye transfer area being used are stretched substantially the same as the dye transfer area, the likelihood of any creases being created in the next unused transfer area is substantially reduced. Thus, no line artifacts will be printed on a dye receiver during dye transfer in the printer.

11 Claims, 11 Drawing Sheets

1

PREVENTING CREASE FORMATION IN DONOR WEB IN DYE TRANSFER PRINTER THAT CAN CAUSE LINE ARTIFACT ON PRINT

CROSS REFERENCE TO RELATED APPLICATIONS

Reference is made to commonly assigned co-pending applications Ser. No. 10/242,241 entitled PREVENTING CREASE FORMATION IN DONOR WEB IN DYE TRANSFER PRINTER THAT CAN CAUSE LINE ARTIFACT ON PRINT, filed Sep. 12, 2002 in the name of Terrence L. Fisher; Ser. No. 10/242,210 entitled PREVENTING CREASE FORMATION IN DONOR WEB IN DYE TRANSFER PRINTER THAT CAN CAUSE LINE ARTIFACT ON PRINT, filed Sep. 12, 2002 in the name of Terrence L. Fisher; Ser. No. 10/242,263 entitled PREVENTING CREASE FORMATION IN DONOR WEB IN DYE TRANSFER PRINTER THAT CAN CAUSE LINE ARTIFACT ON PRINT, filed Sep. 12, 2002 in the name of Terrence L. Fisher; and Ser. No. 10/242,248 entitled PREVENTING CREASE FORMATION IN DONOR WEB IN DYE TRANSFER PRINTER THAT CAN CAUSE LINE ARTIFACT ON PRINT, filed Sep. 12, 2002 in the name of Terrence L. Fisher.

FIELD OF THE INVENTION

The invention relates generally to dye transfer printers such as thermal printers, and in particular to the problem of crease formation in the dye transfer area of a donor web used in the printer. Crease formation in the dye transfer area can result in an undesirable line artifact being printed on a dye receiver.

BACKGROUND OF THE INVENTION

A typical multi-color donor web that is used in a thermal printer is substantially thin and has a repeating series of three different color sections or patches such as a yellow color section, a magenta color section and a cyan color section. Also, there may be a transparent laminating section after the cyan color section.

Each color section of the donor web consists of a dye transfer area that is used for dye transfer printing and pair of longitudinal edge areas alongside the transfer area which are not used for printing. The dye transfer area is about 95% of the web width and the two edge areas are each about 2.5% of the web width.

To make a print, the various color dyes in the dye transfer areas of a single series of yellow, magenta and cyan color sections on a donor web are successively heat-transferred by a print head onto a dye receiver such as paper or transparency sheet or roll. The dye transfer from each transfer area to the dye receiver is done line-by-line widthwise across the transfer area via a bead of selectively heated resistive elements on the print head. The print head makes line contact across the entire width of the color section, but it only beats the dye transfer area, i.e. it does not heat the two edge areas alongside the dye transfer area.

As each color section is used for dye transfer at the print head, the donor web is subjected to a longitudinal tension between a donor supply spool and a donor take-up spool which are rearward and forward of the print head. The longitudinal tension, coupled with the heat from the print head, causes a used color section to be stretched lengthwise at least from the print head to the donor take-up spool. Since the dye transfer area in a used color section has been heated by the print head, but the two edge areas alongside the transfer area have not been heated, the transfer area tends to be stretched more than the edge areas. As a result, the transfer area becomes thinner than the two edge areas and develops a wave-like or ripple distortion widthwise between the edge areas.

After the last line is transferred from a dye transfer area to a dye receiver, and as the used color section is advanced forward from the print head and onto the donor take-up spool, the wave-like or ripple distortion in the transfer area causes one or more creases to form at least in a short trailing or rear end portion of the transfer area that has not been used for dye transfer. The creases tend to spread rearward from the trailing or rear end portion of the used transfer area into a leading or front end portion of an unused transfer area in the next (fresh) color section being advanced to the print head. The creases appear to be created because of the difference in thickness between the used transfer area and the edge areas as they are wound under tension from the print head and onto the donor take-up spool.

When a used color section is wrapped under tension around the donor take-up spool, the edge areas wrap differently on the spool than does the used transfer area because of the difference in thickness between the transfer area and the edge areas. As each additional color section is wrapped around the donor take-up spool, the convolution build-up of the thicker edge areas on the spool becomes significantly greater than the convolution build-up of the thinner transfer areas. This non-uniform winding of the used color section increases the likelihood of one or more creases being created because the convolution build-up of the thicker edge areas on the donor take-up spool adds to the tension and distortion of the used transfer areas.

A problem that can result is that a crease in the leading or front end portion of the unused transfer area of the next (fresh) color section will cause an undesirable line artifact to be printed on a leading or front end portion of the dye receiver when the print head is applied to the crease. The line artifact printed on the receiver is about 0.5 inches in length.

The question presented therefore is how to solve the problem of the creases being created in the unused transfer area of each fresh color section so that no line artifacts are printed on the dye receiver.

SUMMARY OF THE INVENTION

A dye transfer printer in which a donor web having successive dye transfer areas and opposite longitudinal edge areas alongside each one of the dye transfer areas is subjected to a longitudinal tension, when the donor web is advanced in the printer, that can stretch the dye transfer areas more than the edge areas because the dye transfer areas, but not the edge areas, are heated at a print head, is characterized in that:

- a web weakening applicator is positioned to weaken a resistance of the edge areas, relative to the dye transfer areas, to being stretched so that the edge areas can be stretched substantially the same as the dye transfer areas even though only the dye transfer areas are heated.

The edge areas can be weakened, for example, by perforating or piercing them to create holes in them, or by slitting or cutting them to create cuts in them.

If the edge areas alongside a dye transfer area being used are stretched substantially the same as the dye transfer area, the likelihood of any creases being created in the next unused transfer area is substantially reduced.

Thus, no line artifacts will be printed on a dye receiver in the printer.

DETAILED DESCRIPTION OF THE INVENTION

Donor Web

Figure 1:
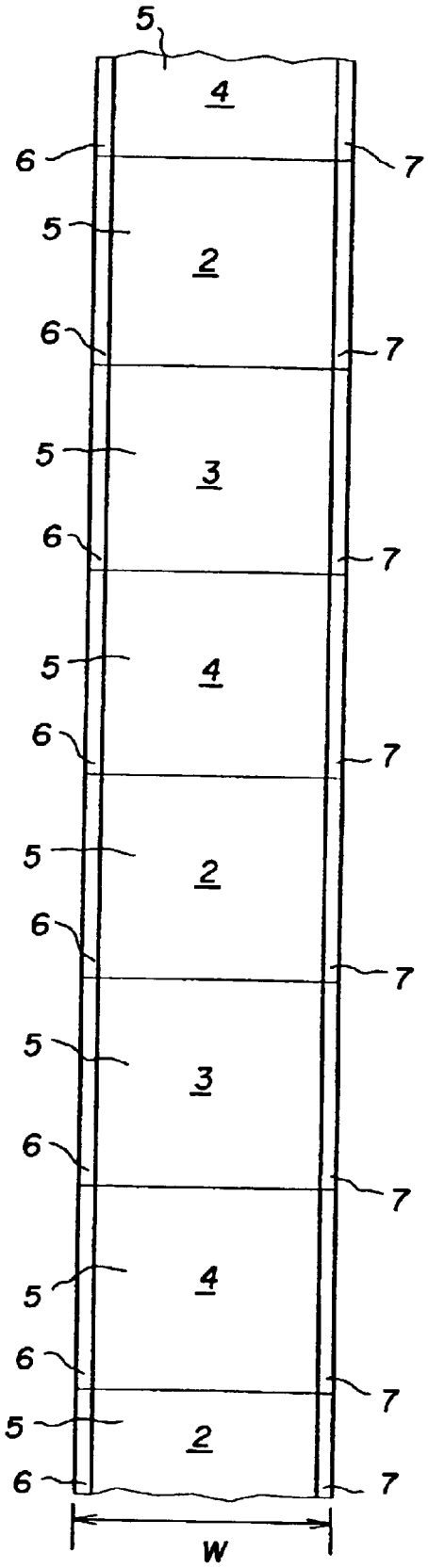
FIG. 1 is plan view of a donor web including successive dye transfer areas and opposite edge areas alongside each one of the dye transfer areas.

FIG. 1 depicts a typical multi-color donor web or ribbon 1 that is used in a thermal color-printer. The donor web 1 is substantially thin and has a repeating series (only two shown) of three different color sections or patches such as a yellow color section 2, a magenta color section 3 and a cyan color section 4. Also, there may be a transparent laminating section (not shown) after the cyan color section 4.

Each one of the successive color sections 2–4 of the donor web 1 consists of a dye transfer area 5 that is used for dye transfer printing and pair of longitudinal edge areas 6 and 7 alongside the transfer area which are not used for printing. The dye transfer area 5 is about 95% of the web width W and the two edge areas 6 and 7 are each about 2.5% of the web width.

Dye Transfer Printer

FIGS. 2–6 depict operation of a known prior art thermal color-printer 10.

Figure 2:
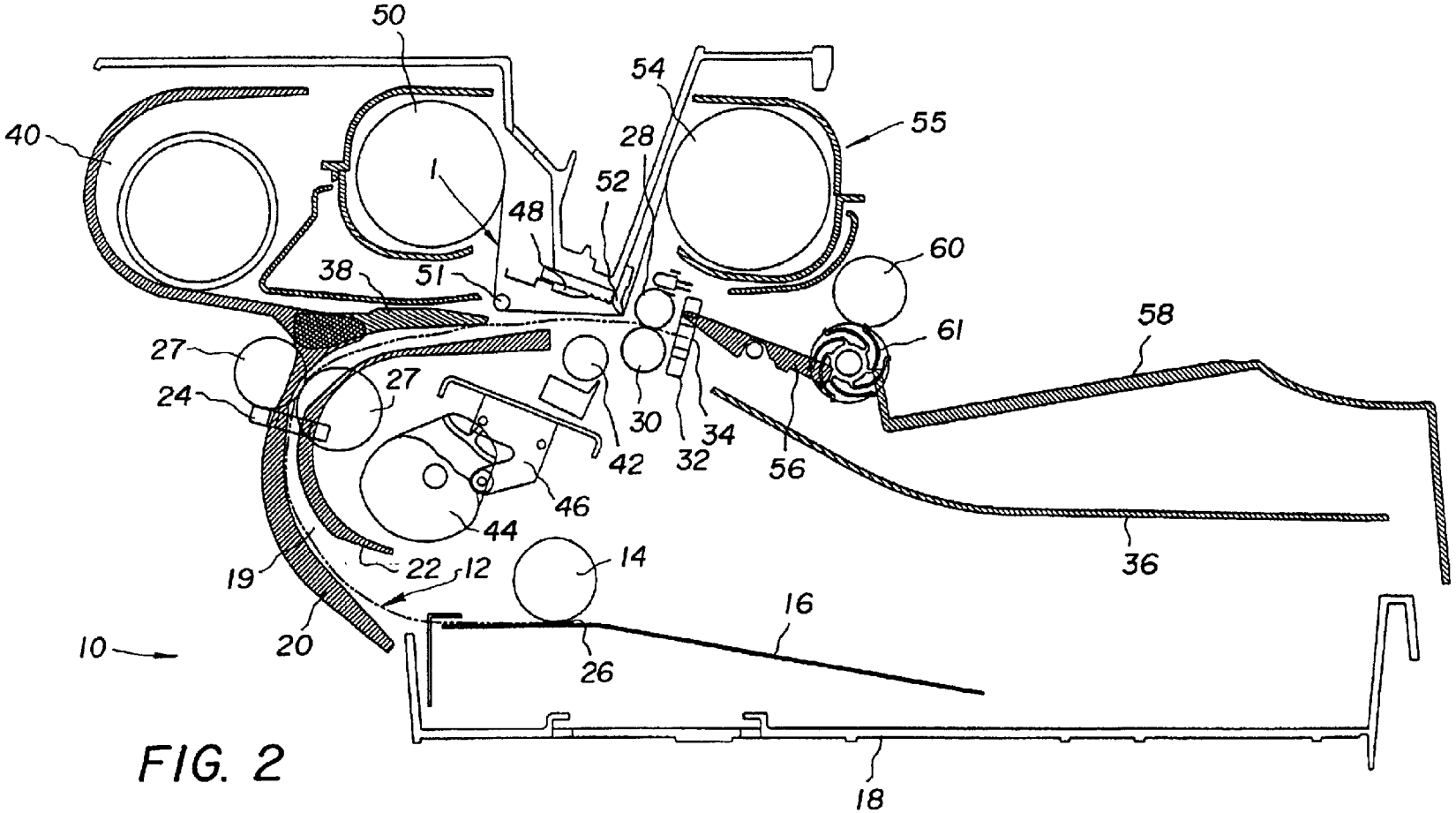
FIG. 2 is an elevation section view, partly in section, of a dye transfer printer, showing a beginning cycle during a printer operation.

Beginning with FIG. 2, a dye receiver sheet 12, e.g. paper or transparency, is initially advanced forward via coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing or rear edge 26 of the receiver sheet 12, it activates at least one of pair of parallel axis urge rollers 27, 27 in the channel 19. The activated rollers 27, 27 advance the receiver sheet 12 forward through the nip of a capstan roller 28 and a pinch roller 30, positioned beyond the channel 19, and to a leading (front) edge sensor 32.

Figure 3:
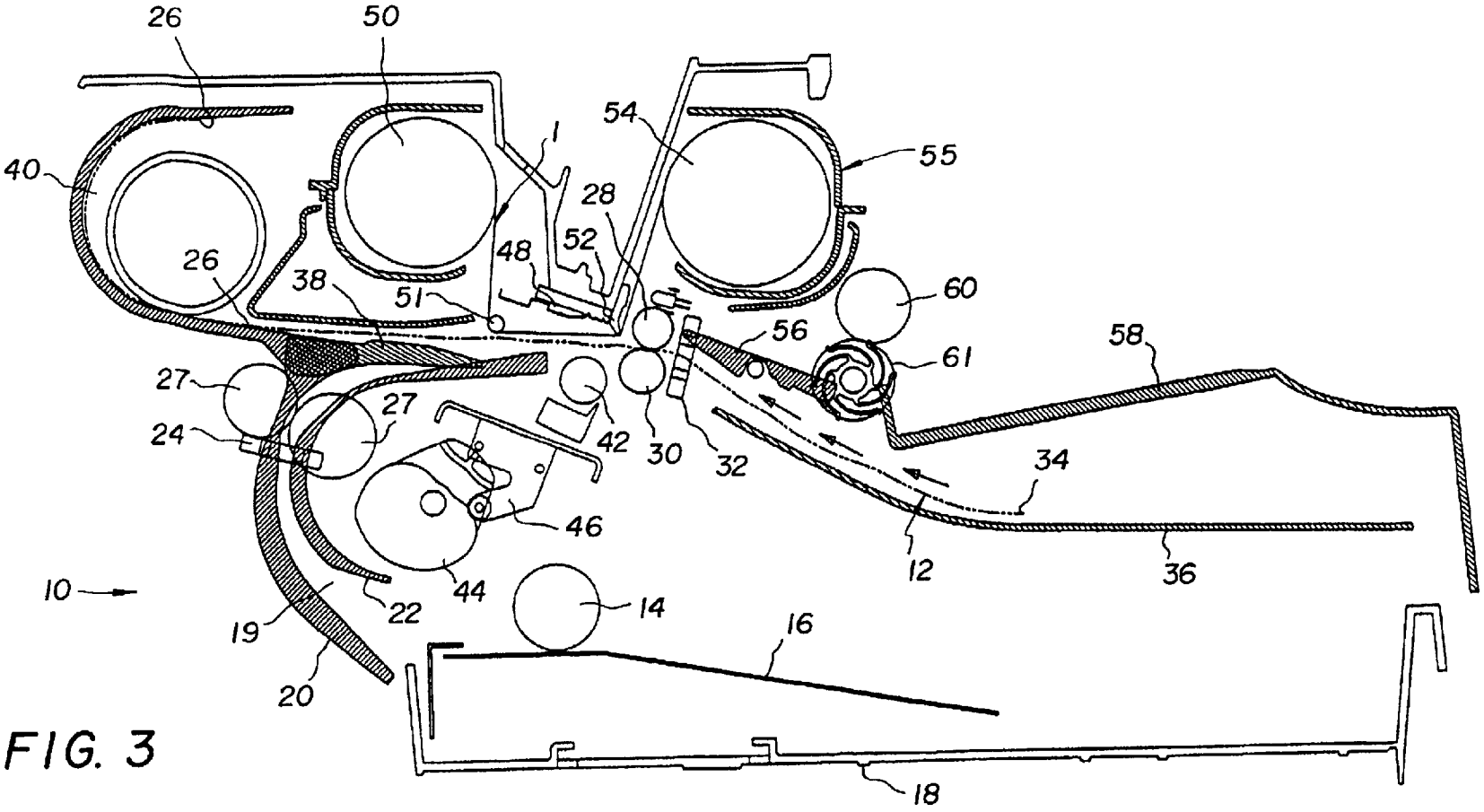
FIGS. 3 and 4 are elevation section views of the dye transfer printer as in FIG. 2, showing other cycles during the printer operation.

In FIG. 3, the leading edge sensor 32 has sensed a leading or front edge 34 of the dye receiver sheet 12 and activated the capstan roller 28 to cause that roller and the pinch roller 30 to advance the receiver sheet forward onto an intermediate tray 36. The receiver sheet 12 is advanced forward into the intermediate tray 36 so that the trailing or rear edge 26 of the receiver sheet can be moved beyond a hinged exit door 38 which is a longitudinal extension of the curved guide 20. Then, as illustrated, the hinged exit door 38 closes and the capstan and pinch rollers 28 and 30 are reversed to advance the receiver sheet 12 rearward, i.e. rear edge 26 first, partially into a rewind chamber 40.

To make a print, the various color dyes in the dye transfer areas 5 of a single series of the color sections 2, 3 and 4 on the donor web 1 must be successively heat-transferred onto the dye receiver sheet 12. This is shown in FIGS. 4 and 5.

Figure 4:
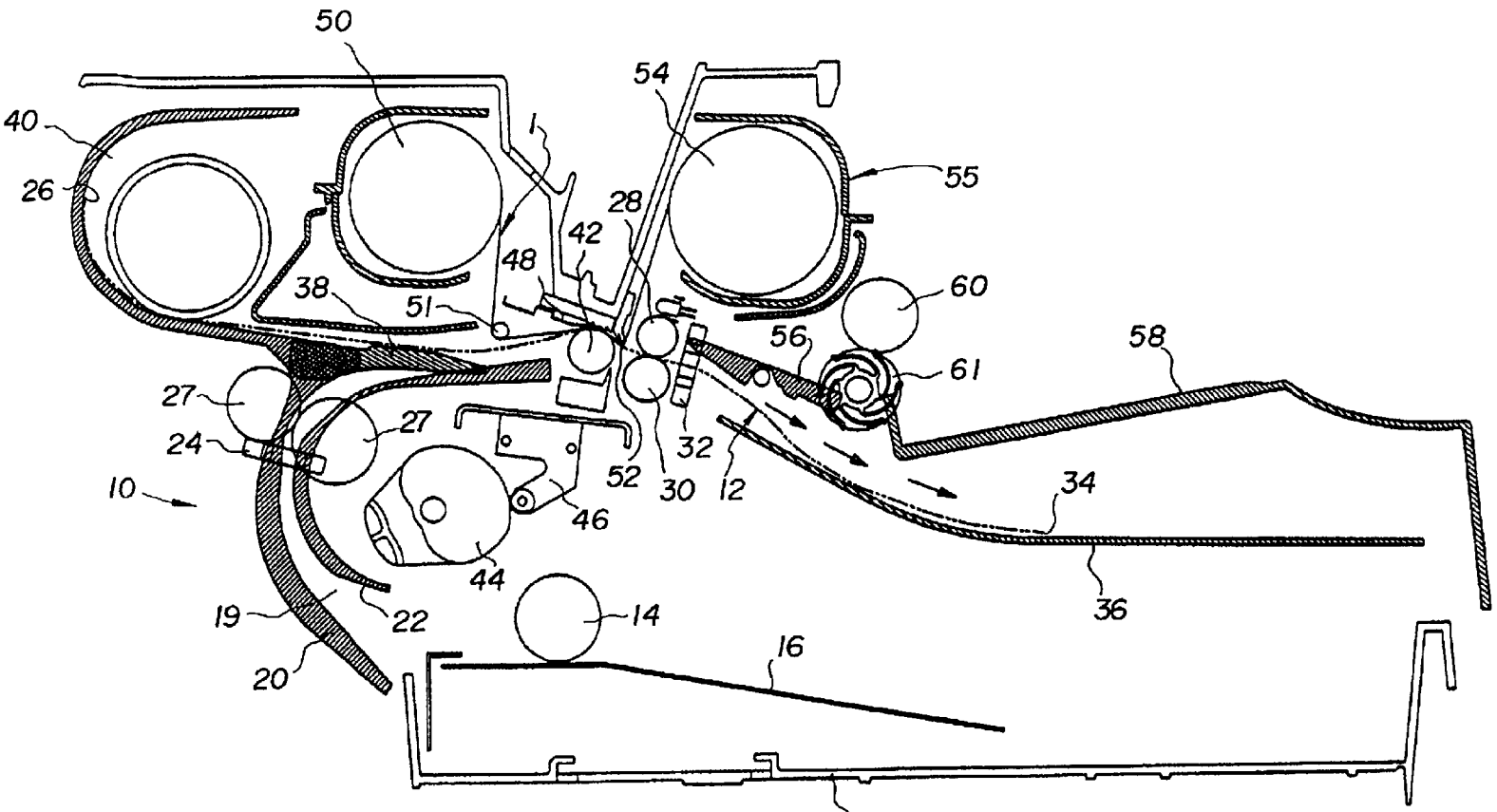

In FIG. 4, a platen roller 42 is shifted via a rotated cam 44 and a platen lift 46 to adjacent a thermal print head 48. This causes the dye receiver sheet 12 and a first one of the successive color sections 2, 3, and 4 of the donor web 1 to be locally held together between the platen roller 42 and the print head 48. The capstan and pinch rollers 28 and 30 are reversed to again advance the dye receiver sheet 12 forward to begin to return the receiver sheet to the intermediate tray 36. At the same time, the donor web 1 is advanced forward under a longitudinal tension, from a donor supply spool 50, over a first stationary (fixed) web guide 51, the print head 48 and a second stationary (fixed) web guide or guide nose 52, and then onto a donor take-up spool 54. The donor supply and take-up spools 50 and 54 together with the donor web 1 are provided in a replaceable cartridge 55 that is loaded into the printer 10.

When the first one of the successive color sections 2, 3 and 4 of the donor web 1 is moved forward in intimate contact with the print head 48 in FIG. 4, the color dye in the dye transfer area 5 of that color section is heat-transferred onto the dye receiver sheet 12. The dye transfer from the transfer area 5 to the receiver sheet 12 is done line-by-line widthwise across the transfer area via a bead of selectively heated resistive elements (not shown) on the print head 48. The print head 48 makes line contact across the entire width W of the first color section 2 as depicted in FIG. 5 (the guide nose 52 and the dye receiver sheet 12 are not shown). However, the print head 48 only heats the dye transfer area 5, i.e. it does not heat two edge areas 6 and 7 alongside the transfer area.

Figure 5:
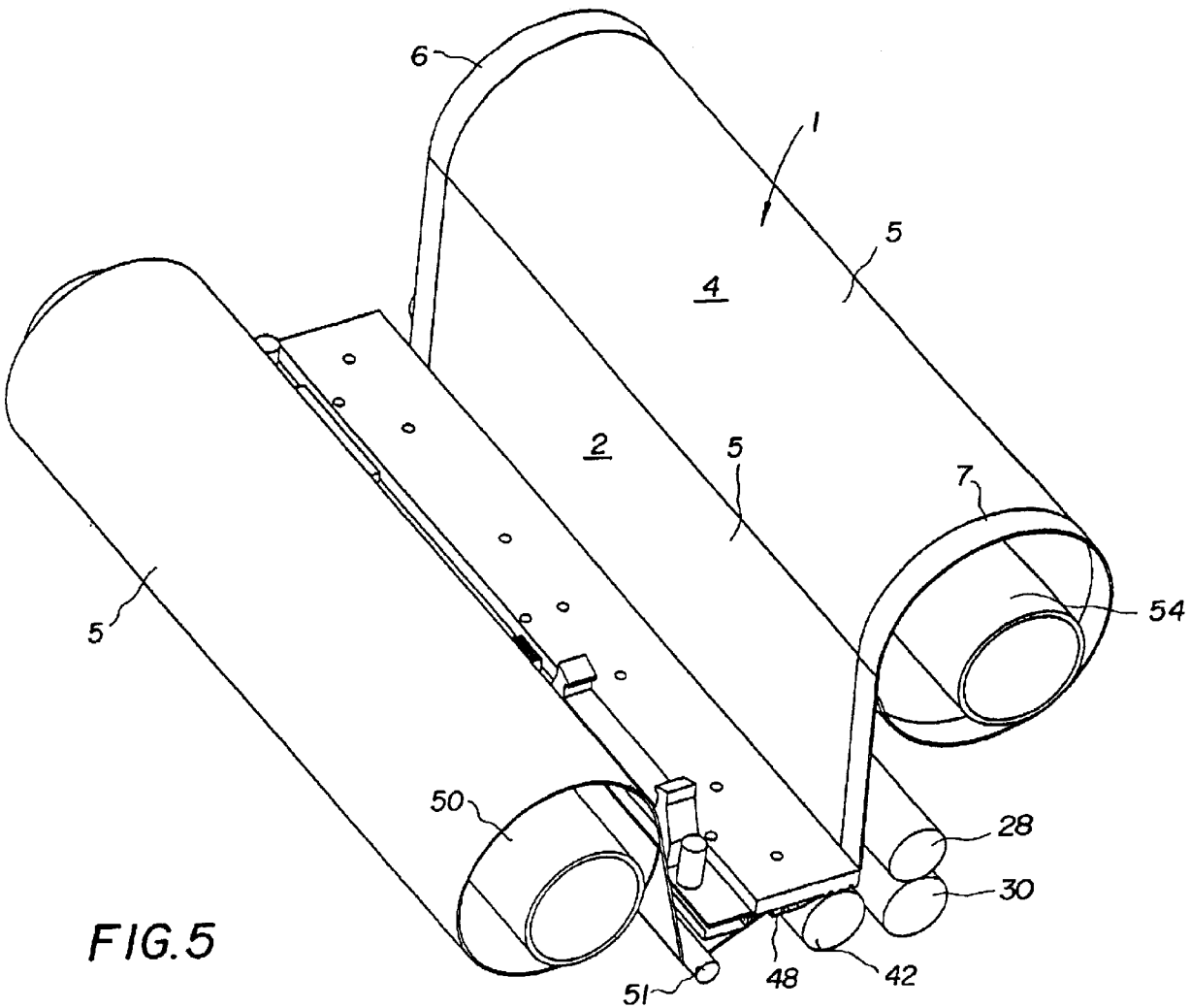
FIG. 5 is perspective view of a printing or dye transfer station in the dye transfer printer.

As the first color section 2 is used for dye transfer line-by-line, it moves from the print head 48 and over the guide nose 52 in FIGS. 4 and 5. Then, once the dye transfer for the first color section 2 is completed, the platen roller 42 is shifted via the rotated cam 44 and the platen lift 46 from adjacent the print head 48 to separate the platen roller from the print head. This is shown in FIG. 3.

Then, the capstan and pinch rollers 28 and 30 are reversed to advance the dye receiver sheet 12 rearward, i.e. trailing or rear edge 26 first, partially into the rewind chamber 40 and the used color section 2 is wrapped about the donor take-up spool 54. See FIG. 3.

Then, the cycle in FIG. 4 is repeated with the next (fresh) one of the successive color sections 2, 3 and 4.

Once the last one of the successive color sections 2, 3 and 4 is used, the dye transfer to the dye receiver sheet 12 is completed. Then, in FIG. 3, the platen roller 42 is shifted via the rotated cam 44 and the platen lift 46 from adjacent the print head 48 to separate the platen roller from the print head, the capstan and pinch rollers 28 and 30 are reversed to advance the receiver sheet 12 rearward, i.e. trailing or rear edge 26 first, partially into the rewind chamber 40, and the last color section 4 is wrapped about the donor take-up spool 54.

Figure 6:
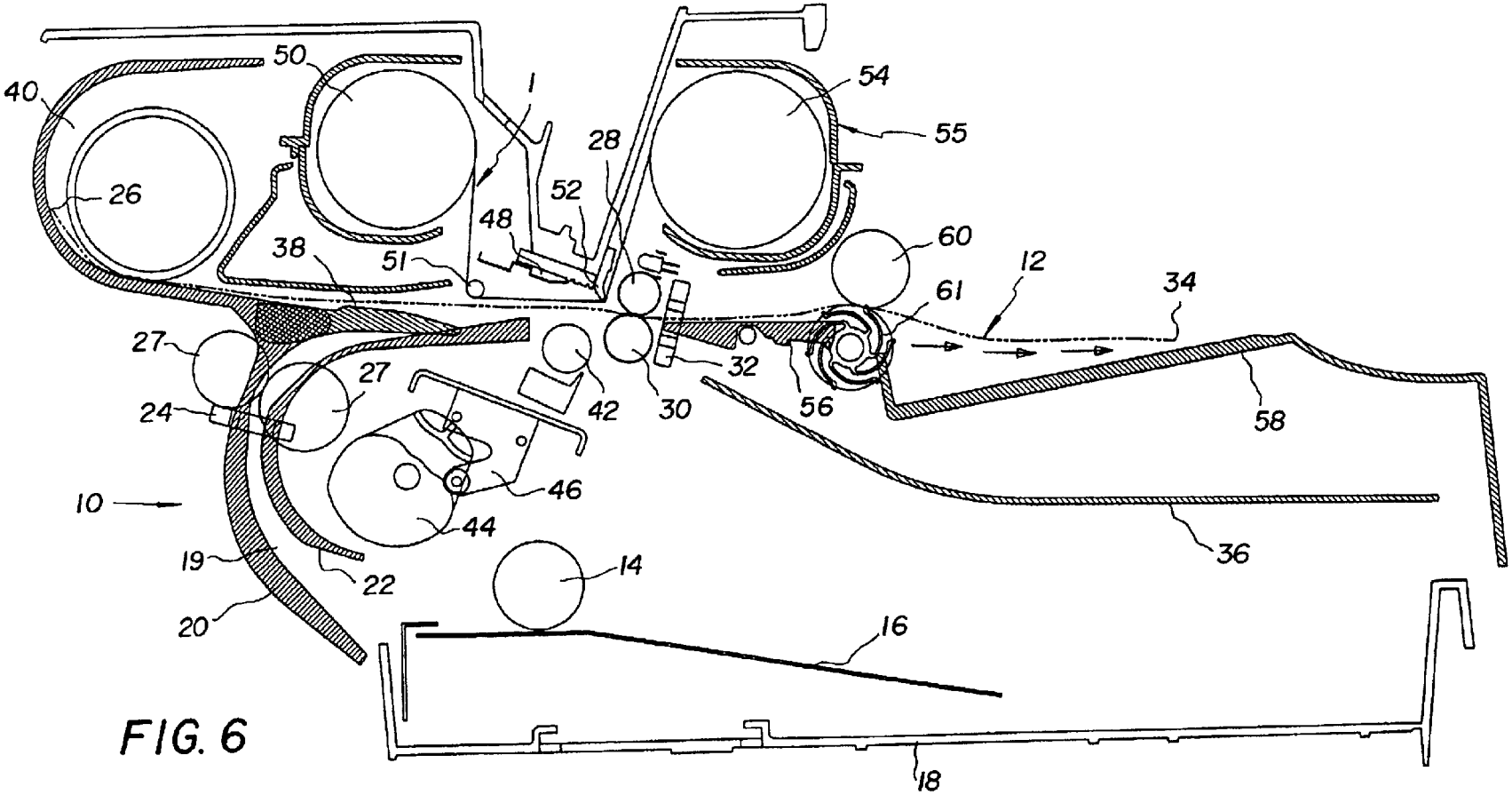
FIG. 6 is an elevation section view of the dye transfer printer as in FIG. 2, showing a final cycle during the printer operation.

Finally, as shown in FIG. 6, the platen roller 42 remains separated from the print head 48 and the capstan and pinch rollers 28 and 30 are reversed to again advance the dye receiver sheet 12 forward. However, in this instance a diverter 56 is pivoted to divert the receiver sheet 12 to an exit tray 58 instead of returning the receiver sheet to the intermediate tray 36 as in FIG. 4. A pair of parallel axis exit rollers 60 and 62 aid in advancing the receiver sheet 12 into the exit tray 58.

Prior Art Problem

Figure 7:
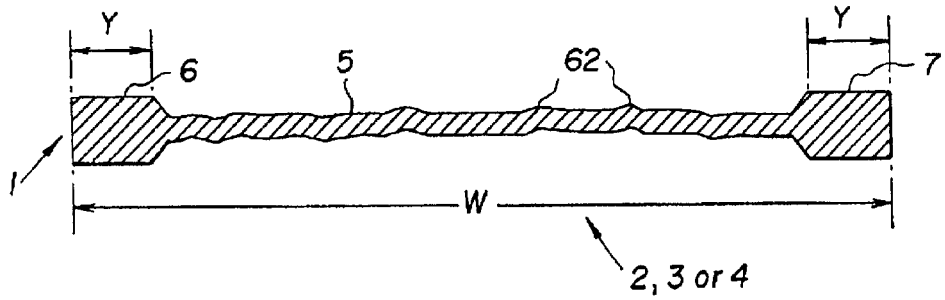
FIG. 7 is a cross section view of the donor web when the dye transfer area has been stretched thinner than the two edge areas alongside the dye transfer area, showing a wave-like or ripple distortion widthwise between the edge areas.

As each one in a single series of the color sections 2, 3 and 4 of the donor web 1 is successively used for dye transfer at the print head 48 in FIGS. 4 and 5, it is stretched lengthwise under tension, particularly over the second stationary (fixed) web guide or guide nose 52. Since the dye transfer area 5 in a used color section 2, 3 or 4 has been heated by the print head 48, but the two edge areas 6 and 7 alongside the transfer area have not been heated, the transfer area tends to be stretched under tension more than the edge areas. As a result, the dye transfer area 5 becomes thinner than the two edge areas and develops a wave-like or ripple distortion 62 widthwise between the edge areas. This is shown in FIG. 7.

After the last line is transferred from a dye transfer area 5 to the dye receiver sheet 12, and as the used color section 2, 3 or 4 is advanced forward from the print head 48, over the guide nose 52, and onto the donor take-up spool 54, the wave-like or ripple distortion 62 in the transfer area causes one or more creases 64 to be formed at least in a short trailing or rear end portion 66 of the transfer area that has not been used for dye transfer. See FIG. 8. The creases 64 tend to spread rearward from the trailing or rear end portion 66 of the used transfer area 5 into a leading or front end portion 68 of an unused transfer area 5 in the next (fresh) color section 2, 3 or 4 being advanced to the print head 48. The creases 64 appear to be created because of the difference in thickness between the used transfer area 5 and the edge areas 6 and 7 as they are wound under tension from the print head 48, over the guide nose 42, and onto the donor take-up spool 54.

When a used color section 2, 3 or 4 is wrapped under tension around the donor take-up spool 54, the two edge areas 6 and 7 wrap differently on the spool than does the used transfer area 5 because of the difference in thickness between the transfer area and the edge areas. See FIGS. 7 and 9. As each additional color section 2, 3 or 4 is wrapped around the donor take-up spool 54, the convolution build-up of the thicker edge areas 6 and 7 on the spool becomes significantly greater than the convolution build-up of the thinner transfer areas 5.

Figure 8:
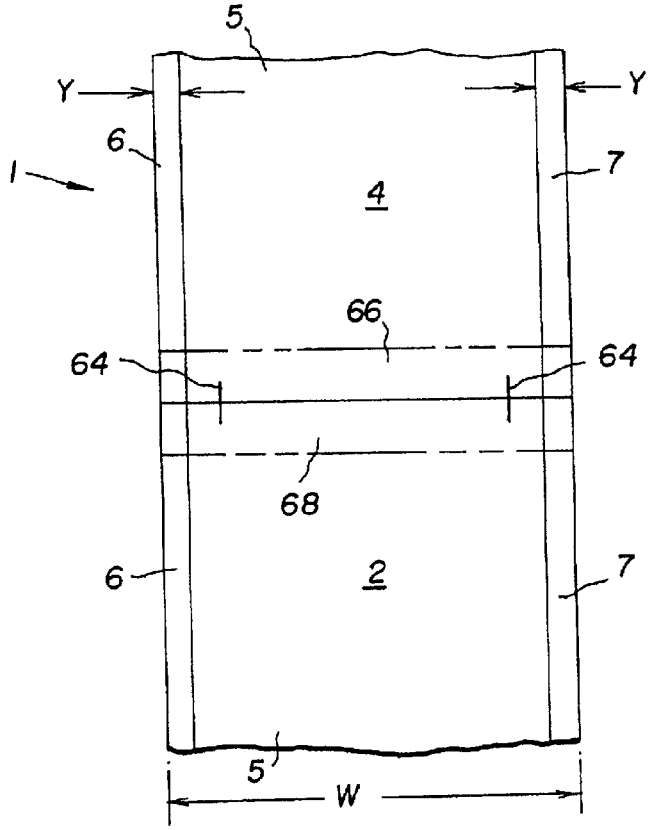
FIG. 8 is a plan view of the donor web, showing creases spreading rearward from a trailing or rear end portion of a used transfer area into a leading or front end portion of an unused transfer area in the next (fresh) color section.
Figure 9:
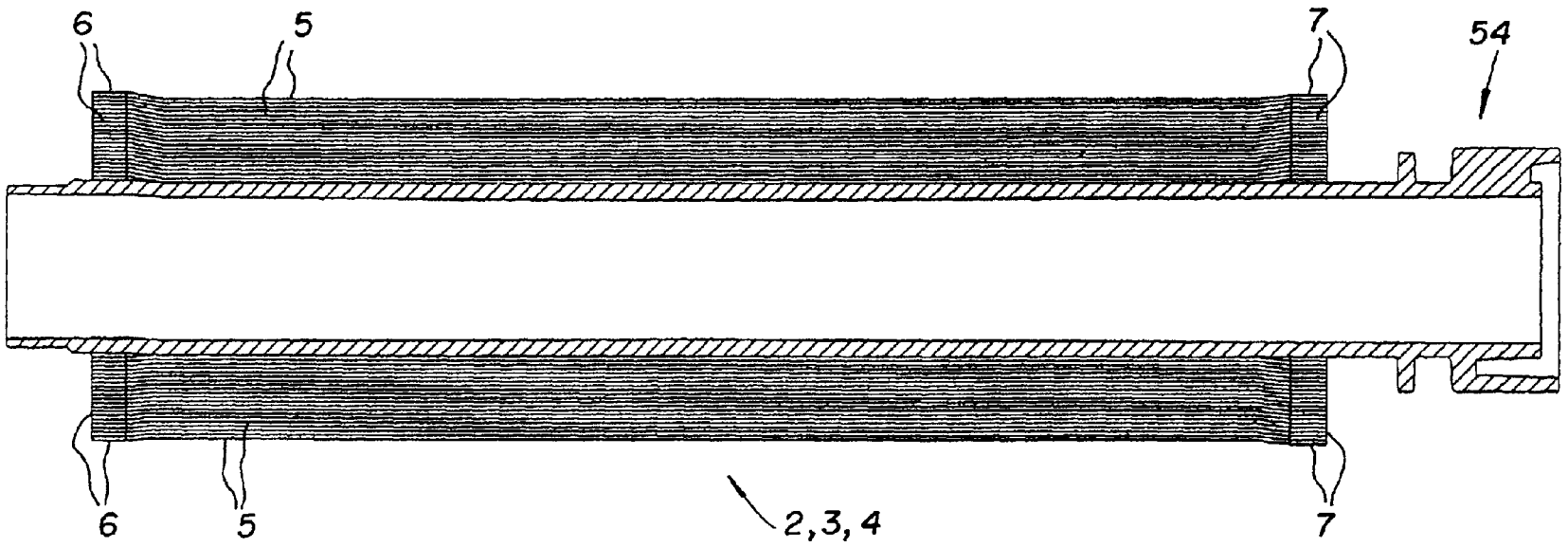
FIG. 9 is a cross-section view of a prior art donor take-up spool in the dye transfer printer.

See FIG. 9. This non-uniform winding of the used color section increases the likelihood of one or more of the creases 64, shown in FIG. 8, being created because the convolution build-up of the thicker edge areas 6 and 7 on the donor take-up spool 54 adds to the tension and distortion of the used transfer areas 5.

Figure 10:
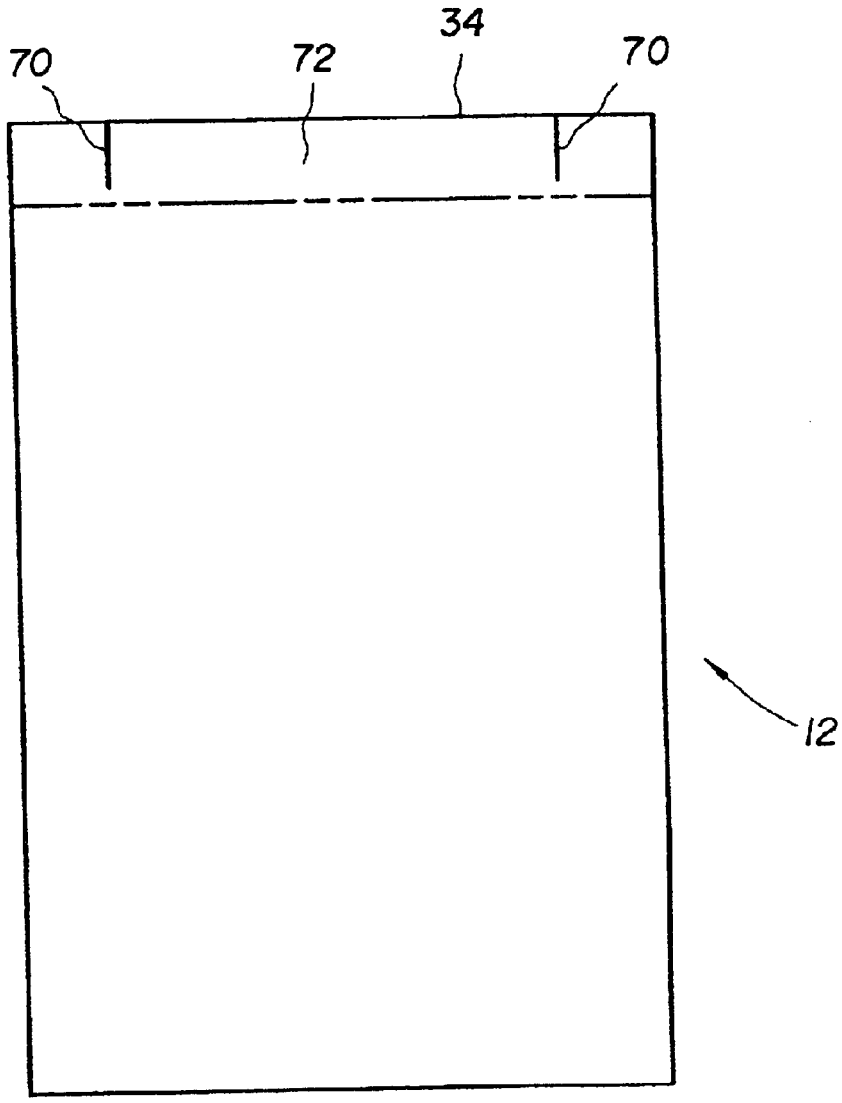
FIG. 10 is a plan view of a dye receiver sheet, showing line artifacts printed on a leading or front edge portion of the receiver sheet.

A problem that can result is that a crease 64 in the leading or front end portion 68 of the unused transfer area 5 of the next (fresh) color section 2, 3 or 4 will cause an undesirable line artifact 70 to be printed on a leading or front end portion 72 of the dye receiver sheet 12 when the print head 48 is applied to the crease. See FIG. 10. The line artifact 70 printed on the dye receiver sheet 12 is about 0.5 inches in length.

The question presented therefore is how to solve the problem of the creases 64 being created in the unused transfer area 5 of each fresh color section 2, 3 or 4 so that no line artifacts 70 are printed on the dye receiver sheet 12.

Solution

It has been determined that the likelihood of the wave-like or ripple distortion 62 developing across the donor web 1 in the dye transfer printer 10 (as shown in FIG. 7) when the donor web 1 is advanced under tension from the donor supply spool 50, over the first fixed web guide 51. the print head 48 and the second fixed web guide 52, and onto the donor take-up spool 54 can be significantly reduced. This is done by weakening a resistance of the successive edge areas 6 and 7, relative to the successive dye transfer areas 2, 3 and 4, to being stretched so that the edge areas can be stretched substantially the same as the dye transfer areas even though only the dye transfer areas are heated by the print head 48. If the wave-like or ripple distortion 62 is prevented from developing across the donor web 1, it is unlikely that any of the creases 64 will be formed in the short trailing or rear end portion 66 of the transfer area 5 that has not been used for dye transfer as shown in FIG. 8. Thus, the possibility of a line artifact 70 being printed on the dye receiver sheet 1 can be substantially eliminated.

Figure 11:
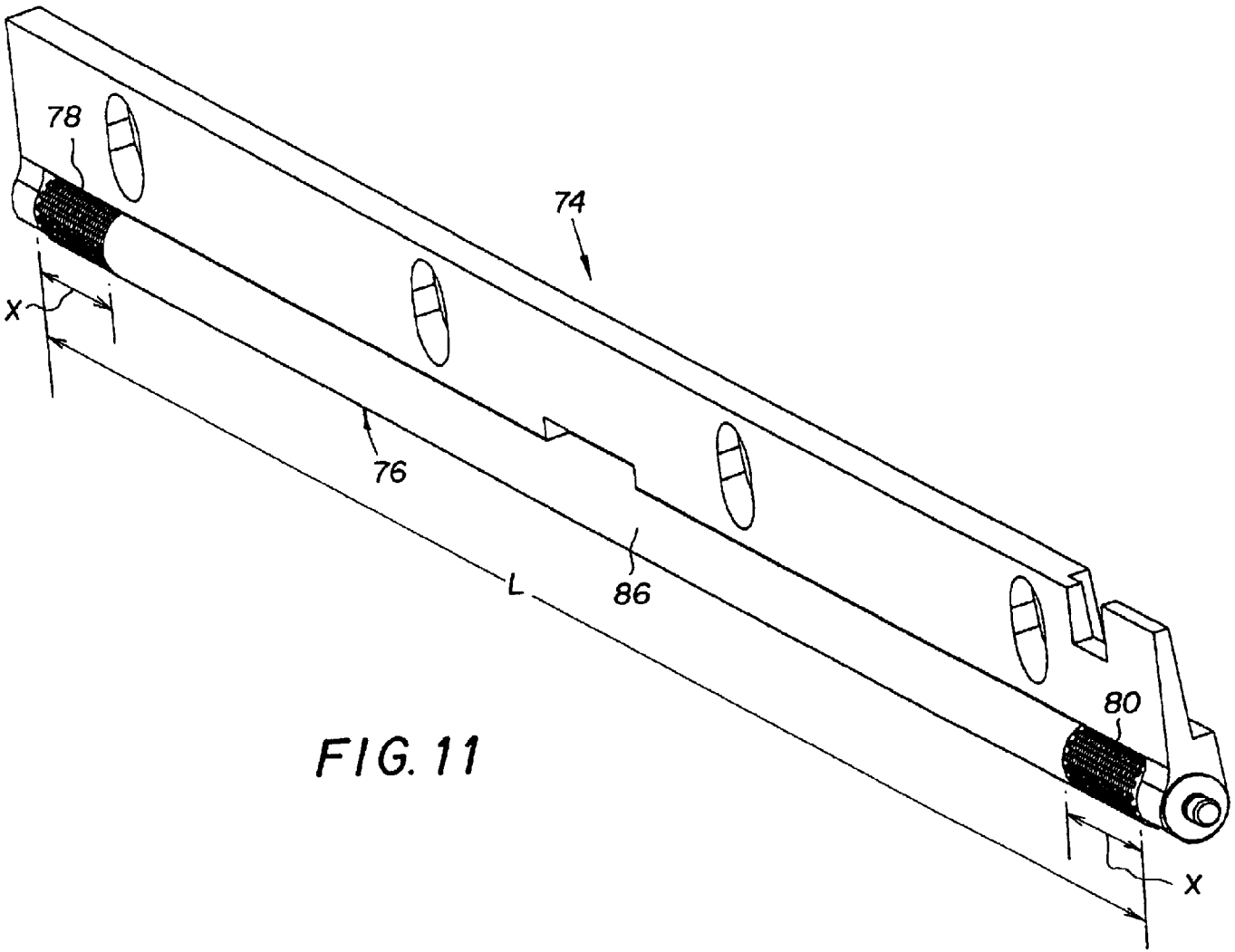
FIG. 11 is a perspective view of an improved web guide (or web weakening applicator) to be used in the dye transfer printer in place of an existing web guide in the printer, which according to a preferred embodiment of the invention weakens a resistance of the edge areas, relative to the dye transfer areas, to being stretched so that the edge areas can be stretched substantially the same as the dye transfer areas.

FIG. 11 depicts non-fixed web guide 74 that is an improvement over the second fixed web guide 52 in the printer 10. The improved web guide 74 is intended to replace the second fixed web guide 52 in the printer 10.

The improved web guide 74 is positioned to extend widthwise across the donor web 1 and serves as a web weakening applicator for the successive edge areas 6 and 7 of the donor web. The web guide 74 is a rotationally supported cylindrical roller 76 having a length L that is slightly greater than the width W of the donor web 1. A pair of identical web contacting portions 78 and 80 of the roller 76 each have a width X that is the same as the individual widths Y of the edge areas 6 and 7 of the donor web 1. See FIGS. 1 and 11.

When the donor web 1 is advanced under tension over the roller 76, the web contacting portions 78 and 80 are similarly rotated in contact with the successive edge areas 6 and 7 of the donor web to continuously perforate or pierce each one of the edge areas before it is wrapped about the donor take-up spool 54. This weakens the resistance of the successive edge areas 6 and 7, relative to the successive dye transfer areas 2, 3 and 4, to being stretched so that the edge areas can be stretched substantially the same as the dye transfer areas.

Figure 12:
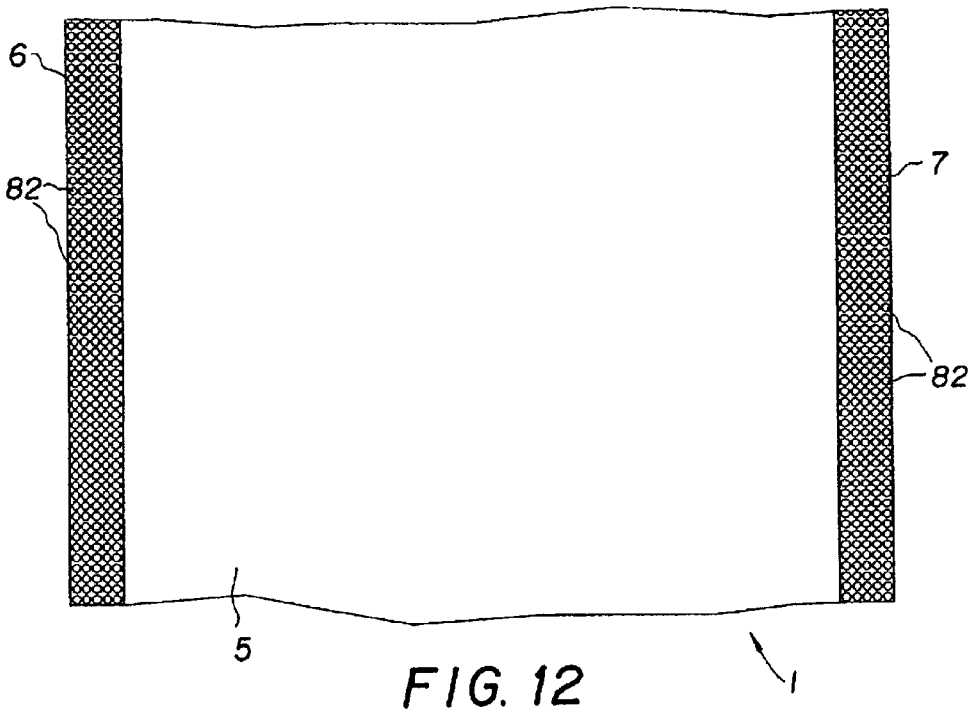
FIG. 12 is a plan view of a web section of the donor web including a dye transfer area and opposite edge areas alongside the dye transfer area, showing the two edge areas perforated to weaken their resistance to being stretched.
Figure 13:
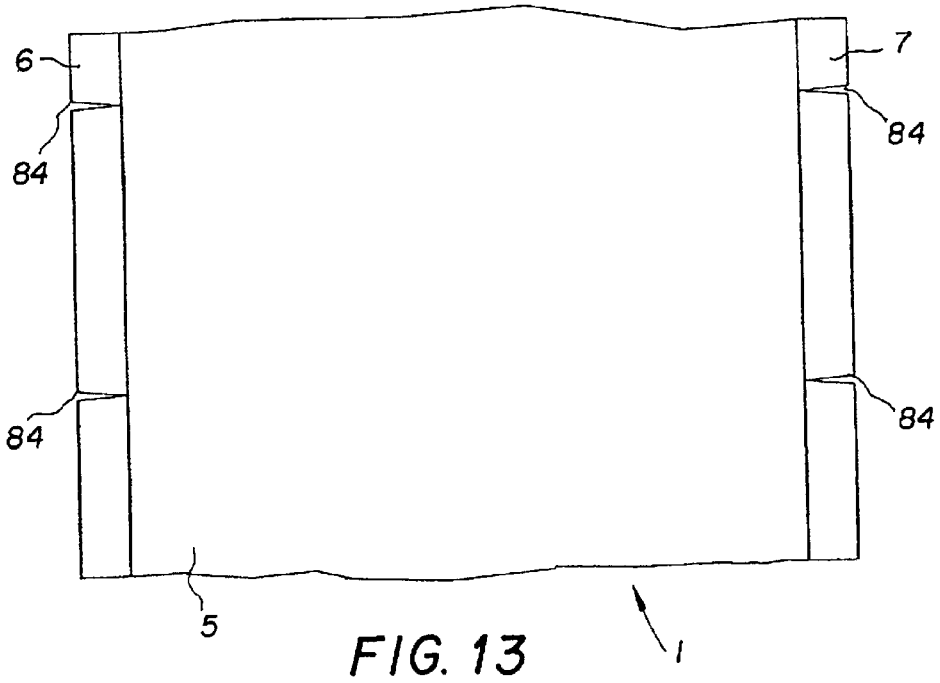
FIG. 13 is a plan view of the web section in FIG. 12, but showing the two edge areas slit or cut to weaken their resistance to being stretched.

The web contacting portions 78 and 80 are illustrated as being diagonally knurled in order to perforate or pierce the successive edge areas 6 and 7 of the donor web 1 to weaken them. However, it will be appreciated by those of ordinary skill in the art that the web contacting portions 78 and 80, instead of being knurled to perforate or pierce the edge areas 6 and 7, can have small pointed projections, small sharp points, or other suitable means which perforate or pierce, or slit or cut the edge areas. In this connection, FIG. 12 shows a web section of the donor web 1 including the dye transfer area 5 and the edge areas 6 and 7, depicting the edge areas perforated or pierced with holes 82 to weaken their resistance to being stretched. And FIG. 13 shows the web section in FIG. 12, but depicting the edge areas 6 and 7 slit or cut with cuts 84 to weaken their resistance to being stretched.

An intermediate portion 86 of the roller 76, between the web contacting portions 78 and 80 is smooth in comparison to the web contacting portions.

The invention has been described in detail with particular reference to certain preferred embodiments thereof, but it will be understood that variations and modifications can be effected within the spirit and scope of the invention. For example, instead of the web guide 74, a pair of lasers (not shown) can be employed to perforate or pierce, or slit or cut the successive edge areas 6 and 7. The lasers could be mounted within the second fixed web guide 52 in the printer 10 to point directly to the edge areas 6 and 7 as the donor web 1 is advanced over the second web guide.

Parts list

1. donor web
2. cyan color section
3. magenta color section
4. yellow color section
5. dye transfer area
6. longitudinal edge area
7. longitudinal edge area
W. web width
10. thermal printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
48. print head
50. donor supply spool
51. first stationary (fixed) web guide
52. second stationary (fixed) web guide or guide nose
54. donor take-up spool
55. cartridge
56. diverter
58. exit tray
60. exit roller
61. exit roller
62. wave-like or ripple distortion
64. creases
66. trailing or rear end portion
68. leading or front end portion
70. line artifacts
72. leading or front end portion
74. improved web guide or web weakening applicator
76. cylindrical roller
L. length
78. web contacting portion
80. web contacting portion
X. width
Y. width
84. holes
86. cuts
86. intermediate portion

What is claimed is:

1. A dye transfer printer in which a donor web having successive dye transfer areas and opposite longitudinal edge areas alongside each one of the dye transfer areas is subjected to a longitudinal tension, when the donor web is advanced in said printer, that can stretch the dye transfer areas more than the edge areas because the dye transfer areas, but not the edge areas, are heated at a print head, is characterized in that:

a web weakening applicator is positioned to weaken a resistance of the edge areas, relative to the dye transfer areas, to being stretched so that the edge areas can be stretched substantially the same as the dye transfer areas even though only the dye transfer areas are heated.

2. A dye transfer printer as recited in claim 1, wherein said web weakening applicator is rotated in contact with the edge areas of the donor web to perforate or pierce the edge areas in order to weaken their resistance to being stretched as the donor web is advanced in said printer.

3. A dye transfer printer as recited in claim 2, wherein said web weakening applicator has web contacting portions substantially the same width as the edge areas of the donor web and that are knurled to perforate or pierce the edge areas.

4. A dye transfer printer as recited in claim 1, wherein said web weakening applicator is rotated in contact with the edge areas of the donor web to slit or cut the edge areas in order to weaken their resistance to being stretched as the donor web is advanced in said printer.

5. A dye transfer printer in which a donor web having successive dye transfer areas and opposite longitudinal edge areas alongside each one of the dye transfer areas is subjected to a longitudinal tension, when the donor web is advanced in said printer, that can stretch the dye transfer areas more than the edge areas because the dye transfer areas and not the edge areas are heated at a print head, is characterized in that:

a web guide is positioned to extend across the donor web and is adapted to perforate or pierce the edge areas, but not the dye transfer areas, to weaken the edge areas sufficiently with respect to the dye transfer areas so that the edge areas can be stretched substantially the same as the dye transfer areas.

6. A dye transfer printer as recited in claim 5, wherein said web guide has web perforating or piercing portions that are rotated in contact with the edge areas of the donor web as the donor web is advanced in said printer.

7. A method of equalizing web-stretching in a dye transfer printer in which a donor web having successive dye transfer areas and opposite longitudinal edge areas alongside each one of the dye transfer areas is subjected to a longitudinal tension, when the donor web is advanced in the printer, that can stretch the dye transfer areas more than the edge areas because the dye transfer areas and not the edge areas are heated at a print head, said method comprising:

weakening a resistance of the edge areas, relative to the dye transfer areas, to being stretched so that the edge areas can be stretched substantially the same as the dye transfer areas even though only the dye transfer areas are heated.

8. A method as recited in claim 7, wherein the resistance of the edge areas of the donor web to being stretched is weakened by rotating a web weakening applicator in contact with the edge areas as the donor web is advanced in the printer.

9. A method as recited in claim 7, wherein the resistance of the edge areas of the donor web to being stretched are weakened by perforating or piercing them.

10. A method as recited in claim 7, wherein the resistance of the edge areas of the donor web to being stretched are weakened by slitting or cutting them.

11. A dye transfer printer in which a donor web having successive dye transfer areas and opposite longitudinal edge areas alongside each one of the dye transfer areas is subjected to a longitudinal tension, when the donor web is advanced in said printer, that can stretch the dye transfer areas more than the edge areas because the dye transfer areas and not the edge areas are heated at a print head, is characterized in that:

web weakening means weakens the edge areas, relative to the dye transfer, the edge areas can be stretched substantially the same as the dye transfer areas even though only the dye transfer areas are heated.

* * * * *

UNITED STATES PATENT AND TRADEMARK OFFICE

CERTIFICATE OF CORRECTION

PATENT NO. : 6,744,456 B2
DATED : June 1, 2004
INVENTOR(S) : Terrence L. Fisher, Sr. et al.

It is certified that error appears in the above-identified patent and that said Letters Patent is hereby corrected as shown below:

Column 10,
Line 15, after "transfer" insert -- areas, so that --

Signed and Sealed this

Eighth Day of February, 2005

JON W. DUDAS
*Director of the United States Patent and Trademark Office*